US005618208A

United States Patent [19]

Crouse et al.

[11] Patent Number: 5,618,208

[45] Date of Patent: Apr. 8, 1997

[54] FULLY INSULATED, FULLY SHIELDED ELECTRICAL CONNECTOR ARRANGEMENT

[75] Inventors: Helen C. Crouse, Waltham, Mass.; Edwin Muz, Reutlingen, Germany; Bernd Rosenfeldt, Hamilton; Thomas K. Naylor, Belmont, both of Mass.

[73] Assignee: Siemens Medical Systems, Inc., Iselin, N.J.

[21] Appl. No.: 253,653

[22] Filed: Jun. 3, 1994

[51] Int. Cl.[6] ..... H01R 13/648

[52] U.S. Cl. ..... 439/609; 439/610; 439/96

[58] Field of Search ..... 439/607, 608, 439/609, 610, 98, 101, 108, 931

[56] References Cited

U.S. PATENT DOCUMENTS

| | | | |
|---|---|---|---|
| 3,391,381 | 7/1968 | Livingston | 439/610 |
| 3,643,208 | 2/1972 | Massa, Jr. | 439/610 |
| 3,744,128 | 7/1973 | Fisher et al. | 439/931 |
| 4,514,029 | 4/1985 | Larx et al. | 439/931 |
| 4,867,692 | 9/1989 | Kerek | 439/101 |
| 4,974,075 | 11/1990 | Nakajima | 439/610 |
| 5,035,650 | 7/1991 | Defibaugh et al. | 439/609 |
| 5,112,252 | 5/1992 | Harris | 439/610 |

FOREIGN PATENT DOCUMENTS

| | | |
|---|---|---|
| 0118168 | 9/1984 | European Pat. Off. . |
| 0207322 | 1/1987 | European Pat. Off. . |
| 0340327 | 1/1989 | European Pat. Off. . |
| 0316710 | 5/1989 | European Pat. Off. . |
| 0553372 | 4/1993 | European Pat. Off. . |

*Primary Examiner*—Hien Vu
*Attorney, Agent, or Firm*—Lawrence C. Edelman

[57] ABSTRACT

A shielded electrical connector having an elongated annular housing composed of an electrically insulative material molded so as to form an elongated structure for the connector and at least a portion of a grasp for a user of said connector. The housing defines outside and inside surfaces and front and rear ends for said connector. A contact holding portion composed of an electrically insulative material is positioned inside said annular housing and includes a plurality of electrically conductive signal contacts positioned therein so as to be completely surrounded by, yet spaced a distance away from, the inside surface of the housing. An elongated annular electrically conductive shield having inner and outer sides is insert molded with the housing so as to be disposed between its outside and inside surfaces. The elongated shield has a proximal end adapted for being coupled to a common shield associated with the plurality of signal conductors and a distal end extending to and encapsulated by the front end of the housing, yet the front end of the housing leaving an unencapsulated portion of the inside surface of the shield which is spaced a predetermined distance away from the front end of the housing. The un-encapsulated portion of the inside surface of the shield is adapted for making electrical contact with a shield of a mating multi-conductor connector so as to provide an effectively continuous conductive shield which completely surrounds the electrically conductive signal contacts.

13 Claims, 3 Drawing Sheets

FULLY INSULATED, FULLY SHIELDED ELECTRICAL CONNECTOR ARRANGEMENT

BACKGROUND OF THE INVENTION

1. Field of the Invention

The present invention relates to electromagnetically shielded electrical connectors, and more particularly to an electrical connector having a conductive shield which is fully insulated from being contacted by a user of the connector and also fully shields the electrical contacts of the connector with respect to electromagnetic interference.

2. Description of the Prior Art

Shielded electrical connectors provide a means for both shielding electrical connections from external electromagnetic signals and preventing the systems which use the connectors from emitting electromagnetic signals. The connectors generally accomplish this goal by providing a means which continues the shielding of a shielded cable either to another shielded cable or to an electronic device. Shielded electrical connectors are typically found in telecommunications and computer applications, and furthermore are increasingly being used in patient monitoring situations, such as within a hospital or operating room, due to the proliferation of electronic devices in these environments which emit electromagnetic interference, such as a portable cellular telephone, electrosurgical instrumentation, defibrillators, etc.

Furthermore, high frequency electromagnetic signals are susceptible to interference from other undesirable electromagnetic signals. In addition, these signals also naturally generate unwanted electromagnetic signals of their own which may interfere with other electronic devices. Thus, the use and transmission of high frequency electrical signals, as well as the shielding for preventing high frequency electrical signals from contaminating desired signals, establishes the need for shielded electrical connections. Still furthermore, electromagnetic shielding is generally required to satisfy a relevant government standard which places limits on the emission of interfering electromagnetic signals, such as the United States Federal Communications Commission for telecommunications applications and the United States Food and Drug Administration for patient monitoring equipment. The use of a grounded continuous metal shield which surrounds the electrical wiring, cable or electronic device is an effective way to minimize these undesirable effects and satisfies most applicable standards. Finally, shielded electrical connectors are necessary to maintain the integrity of a shielded system from one device to another device.

Electrical connectors are known in the art which generally comprise an insulative or dielectric housing which contains a plurality of terminals and a like plurality of terminal passages. In addition, a pair of metal shell members are fixed to the outside of the insulative housing to form a electromagnetic shield for the connector. Although such electromagnetic shields may be sufficient for use in some environments, in the patient monitoring environment an exposed shield would be extremely undesirable, as well as not meeting applicable safety standards, since it can be contacted by the patient or hospital care provider and thereby possibly transfer a dangerous electrical shock. Conductive shields for connectors are also known in the prior art which reside along an inside surface of the electrical connector, and therefore are not exposed on the outside thereof where they can be contacted by the patient or hospital care provider.

However, these known prior art insulated shields are not known to have provided for a continuous electromagnetic shielding of the electrical contacts inside the connector. That is, it is necessary that the electrical connections provided by the electrical contacts be fully shielded across their connection to a mating connector in order to prevent electromagnetic interference from "seeping in" through gaps in the electromagnetic shield which occur between one electrical connector and another, and thereby contaminate the signals being carried by the signal conductors connected to the electrical contacts. Additionally, a fully shielded connector will prevent a "seeping out" of a portion of the electrical signals being carried by the connector.

It is an object of the present invention to provide an electrical connector with a conductive shield which fully shields the electrical contacts of the electrical connector along their length and which mates with and continues the shield of a mating electrical connector, so that the electrical connections made by the connector are fully shielded across the connection.

Additionally, it is necessary in some situations that the conductive shield be completely insulated from being contacted by a user of the electrical connector.

It is a further object of the invention to provide a fully shielded, fully insulated electrical connector which can be manufactured in a manner which is simple and inexpensive.

SUMMARY OF THE INVENTION

The foregoing objects are obtained by a shielded electrical connector having an elongated housing composed of an electrically insulative material molded so as to form an elongated structure for the connector which forms at least a portion of a grasp for a user of said connector. The housing defines outside and inside surfaces and front and rear ends for said connector. A contact holding portion composed of an electrically insulative material is positioned inside said annular housing and includes a plurality of electrically conductive signal contacts positioned therein so as to be completely surrounded by, yet spaced a distance away from, the inside surface of the housing. In the preferred embodiment, an elongated annular electrically conductive shield having inner and outer sides is insert molded with the housing so as to be disposed between its outside and inside surfaces. The elongated shield has a proximal end adapted for being coupled to a common shield associated with the plurality of signal conductors and a distal end extending to and encapsulated by the front end of the housing, yet the front end of the housing leaving an un-encapsulated portion of the inside surface of the shield which is spaced a predetermined distance away from the front end of the housing. The un-encapsulated portion of the inside surface of the shield is adapted for making electrical contact with a shield of a mating multi-conductor connector so as to provide an effectively continuous conductive shield which completely surrounds the electrically conductive signal contacts.

Other objects, advantages and features of the present invention will become apparent upon reading the following detailed description and appended claims, and upon reference to the accompanying drawings.

BRIEF DESCRIPTION OF THE DRAWINGS

FIG. 2*b* is a plan view of a conductive shield shown in FIG. 2*a.

DETAILED DESCRIPTION OF THE PREFERRED EMBODIMENT

Figure 1:
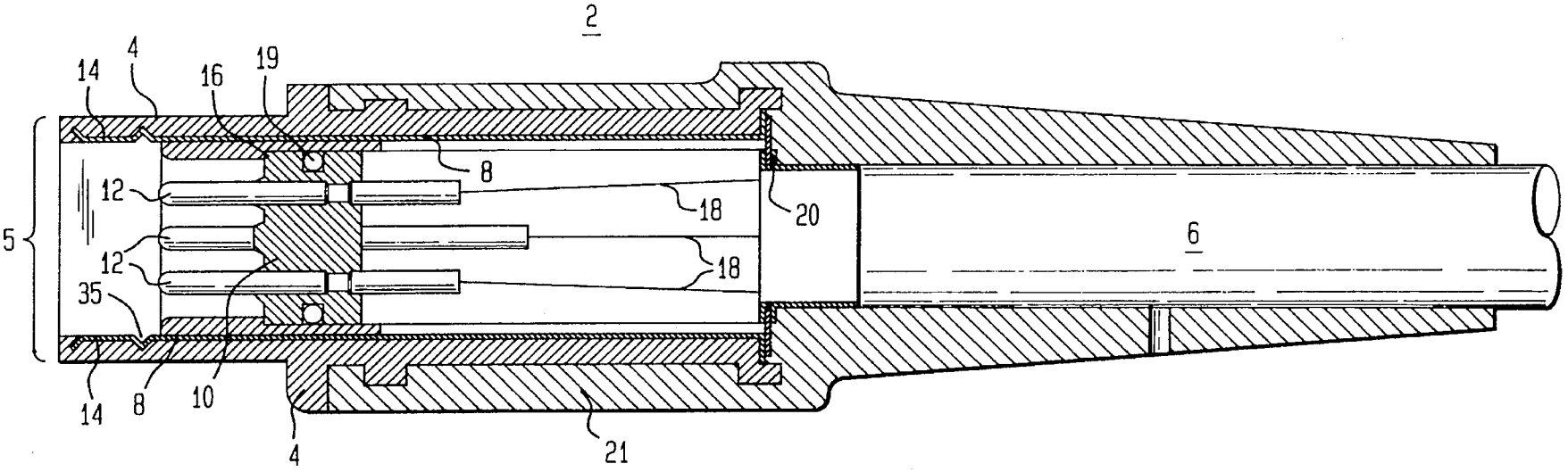
FIG. 1 is a sectional side elevation view of a plug-type electrical connector constructed in accordance with the principles of the present invention.

Referring to FIG. 1, a plug-type electrical connector 2 is shown which is constructed in accordance with the principles of the present invention. It starts with a housing portion 4 comprised on an electrically insulating hard plastic which is molded into the general shape of an elongated tube which at least in part forms a grasp for a user of the connector. One end of housing 4 comprises a front end 5 of connector 2 which is dimensioned for making a mating physical and electrical connection with another electrical connector and an oppositely positioned rear or proximal end is secured to the free end of a multi-conductor cable 6 having a common electromagnetic conductive shield therein which surrounds the multi-conductors inside of cable 6 and provides electromagnetic shielding therefore.

A tubular, i.e., an elongated and annular, electrically conductive shield 8 is insert molded within housing 4 and extends from near the front end 5 of housing 4 to its rear end wherein it makes electrical contact with the common shield of cable 6. In the preferred embodiment, conductive shield 8 is formed by a metallic tube.

An electrical contact holding portion 10 is also comprised of an electrically insulating plastic and is dimensioned to fit inside housing portion 4. A plurality of electrical contacts 12, in the illustrated embodiment pins 12, are insert molded with contact holding portion 10. Pins 12 are connected at their rear or proximal end to respective ones of signal conductors from cable 6, and their distal or free ends extend in the direction of the front end 5 of connector 2, but stop a predetermined distance short thereof.

During manufacture of connector 2, shield 8 is insert molded within housing 4 so that shield 8 is completely insulated from being touched by a user of connector 2. That is, the only portion of shield 8 which can be contacted for making connection with another connector is a portion 14 which is spaced back from the front end 5 of connector 2 and only accessible along the inside surface of housing 4. Thus, housing 4 not only protects the user from contacting shield 8 along the outside of connector 2 but also encapsulates the distal end of shield 8 so as to protect the user from inadvertently contacting the shield when the front end 5 of connector 2 is grasped by the user. Furthermore, it also provides an additional degree of isolation between the shield and electrical contact pins 12 along that portion of pins 12 which extend past contact holding portion 10 in the direction of the front end 5 of connector 2. This extra insulation between the shield and pins 12 improves the dielectric strength and increases the creeping distance provided by housing 4.

To manufacture the electrical connector on a coaxial cable a free end of cable 6 is treated so that its individual insulated conductors have their conductive wires 18 connected to respective ones of pins 12. Pins 12 are then insert molded with contact holding portion 10. Next, contact holding portion 10 with pins 12 therein is inserted into housing 4 until it abuts against an annular shoulder 16. A seal between contact holding portion 10 and housing 4 is provided by an O-ring 19. Next, the space behind contact holding portion 10 and inside housing 4 is filled with an electrically insulating potting material. Alternatively, in an appropriate circumstance depending upon the delicate nature of wires 18 and the expected environment and/or use of the connector, the potting of the space can be omitted. After the potting material has cured an electrically conductive contact bushing 20, which makes electrical connection by a press fit with the shield of cable 6, is soldered to the proximal end of connector shield 8. Connector 2 is finished by providing a soft overmold layer 21 of soft rubber material, such as polyurethane, PVC or silicone rubber to complete the grasp portion. Note, in the completed connector, shield 8 completing surrounds, yet is spaced away, from pins 12.

Figure 2B:
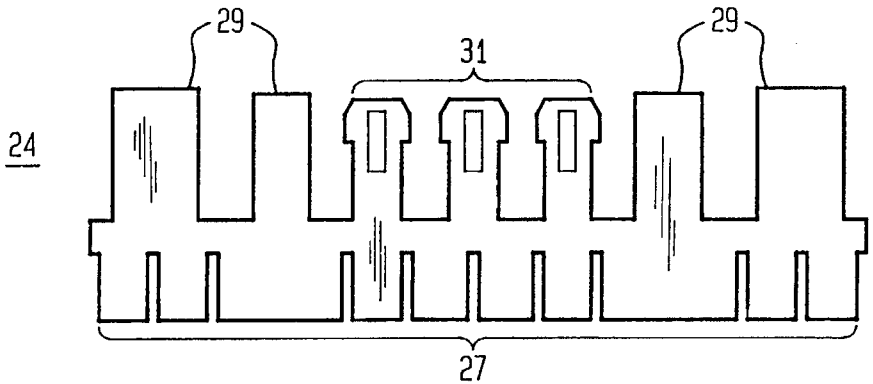
Figure 2A:
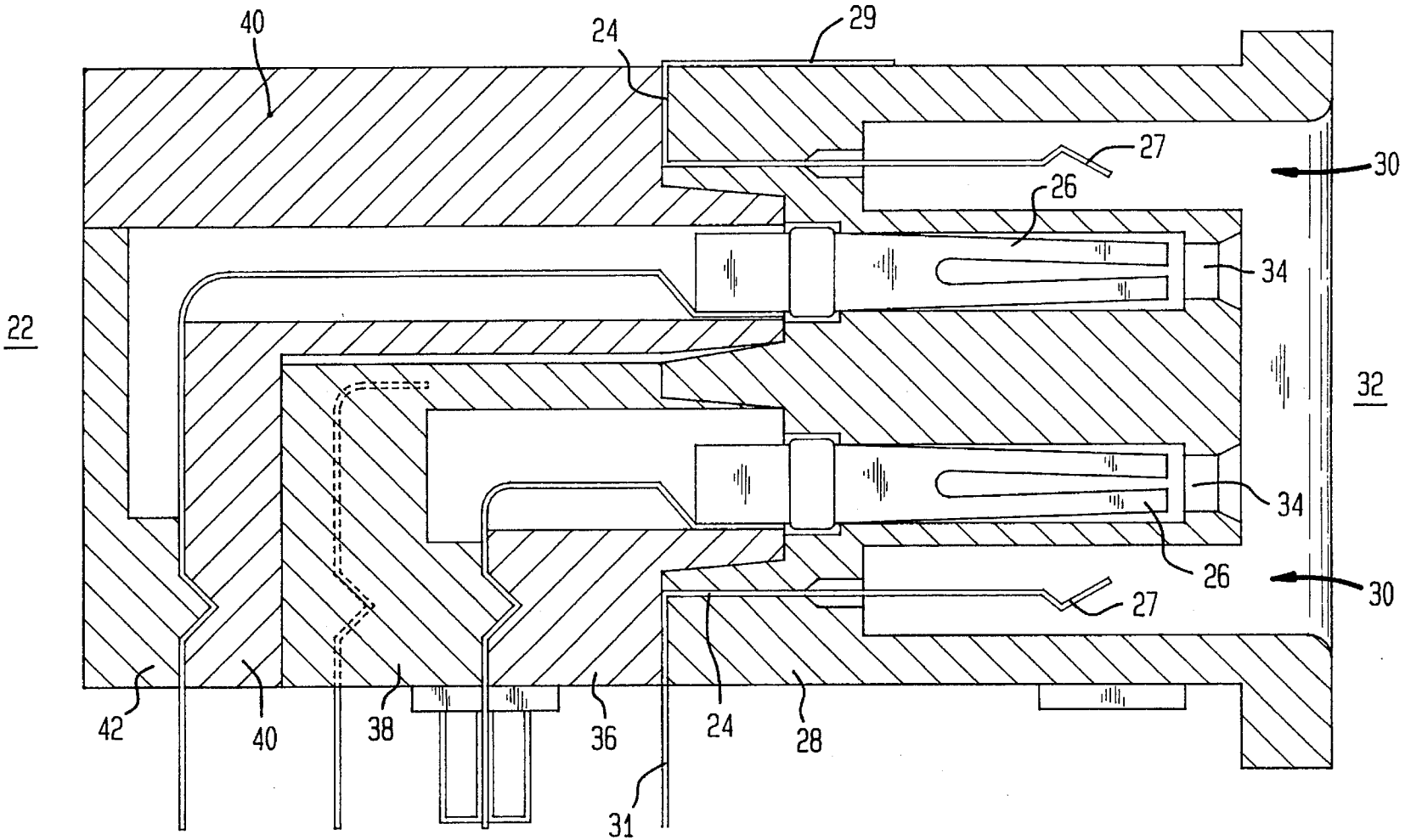
FIG. 2*a* illustrates a sectional side elevation view of a receptacle type electrical connector for use with the plug-type electrical connector illustrated in FIG. 1

FIG. 2*a* illustrates a receptacle-type electrical connector 22 dimensioned so as to receive therein the front end 5 plug-type electrical connector 2. Connector 22 includes a conductive shield 24 which completely surrounds, yet is spaced away from, its electrical contacts 26. Electrical contacts 26 are configured so as to comprise sockets or sleeves for receiving pins 12 therein when plug connector 2 is electrically and physically mated with receptacle connector 22.

As shown more clearly in FIG. 2*b,* shield 24 is shaped so as to have a plurality of tab-like protrusions. The tab-like protrusions illustrated in the top portion of the shield are those which extend to the outside of electrical connector 22 for making a substantially continuous electrical connection to a reference or ground potential, and the tab-like protrusions illustrated in the bottom portion of shield 24 are bent so as to provide tab-like protrusions 27 which are circumferentially spaced inside of recess 30 of electrical connector 22 for making a substantially continuous electrical connection to the shield of a mating connector. Additionally, the tab-like protrusions 27 also serve to form a spring-like latch, useful for making a substantially continuous electrical connection to the shield of the mating connector, when the connectors are mated together. In a given embodiment, the maximum spacing between protrusions 27 is determined by the shortest wavelength electromagnetic signal it is desired to effectively shield.

For manufacturing electrical connector 22 a first layer 28 comprising an electrically insulative plastic material is dimensioned so as to provide a receptacle or recess portion 30 dimensioned so as to receive the front end 5 of connector 2. A central portion 32 of first layer 28 includes a plurality of electrical contact holes 34 arranged therein in a spaced manner. In a preferred embodiment for a 16 pin connector, layer 28 includes 3 rows of contact receiving holes 34, and is generally shaped as an oval. In the illustrated sectional view of FIG. 2*a,* only the top and bottom rows of contacts 26 are illustrated, the middle row being positioned in an offset manner from the top and bottom rows, so as to improve the packing density of the contacts, as conventional in this art.

Next, contacts 26 which are adapted to make electrical connections with pins 12 of connector 2 are inserted into holes 34. Additionally, shield 24 is pre-bent so as to have the shape, circular or oval, of layer 28 and additionally its tab-like protrusions which will be positioned inside space 30 are bent as shown in FIG. 2*a* to form the latch-like portions 27 which are used for not only making electrical contact with the shield of mating connector 2, but for also providing a frictional contact to an annular depression 35 in portion 14 of shield 8 so as to physically hold the connectors together. Next, shield 24 is inserted into layer 28 so that tab-like protrusions 27 are inserted into space 30. Additionally, the other end of shield 24 has some of its tab-like protrusions 29 bent 180° so as to fold back upon the outside surface along the top of layer 28 and the remainder of the tab-like protrusions 31 are bent 90° so as to be directed away from layer 28 and also are shaped to provide a tight snap-fit into retaining/electrical connection slots formed in a circuit board. Next, a second insulating layer 36 is inserted into a rear side of first layer 28 and functions to hold the lower row of electrical contacts 26 in place, as well as shield 24. Next, the signal conductor leads for the second row of electrical contacts 26 is bent 90° so as to be positioned along the backside of layer 36 and then a further insulating layer 38 is attached to layer 36 for holding in the middle row of contacts 26. The signal conductor leads for the middle row of contacts are then bent 90° so as to be positioned along the back portion of layer 38 and then a fourth insulating layer 40 is attached to the assembly for holding in the top row of electrical contacts 26. Finally, the conductor leads for the top row of contacts are bent 90° so as to be positioned along the back portion of layer 40 and a base cap 42 is applied to layer 40 for holding the signal conductor leads for the top row of contacts in place and completing the assembly of receptacle 22.

As noted above, some of the tab-like portions of shield 24 are bent 180° and some are bent only 90°. Those that are bent 90° (as shown at the bottom portion of FIG. 2*b*) form signal contacts which are inserted into a printed circuit board in conjunction with the contacts 42 for holding connector 22 on a printed circuit board and those that are bent 180° are positioned about the top and sides of connector 22 and are useful for providing auxiliary connection to a reference plane so that, as previously discussed, shield 24 provides an effectively continuous electromagnetic shield which surrounds the electrical connections provided by the connector.

Figure 3:
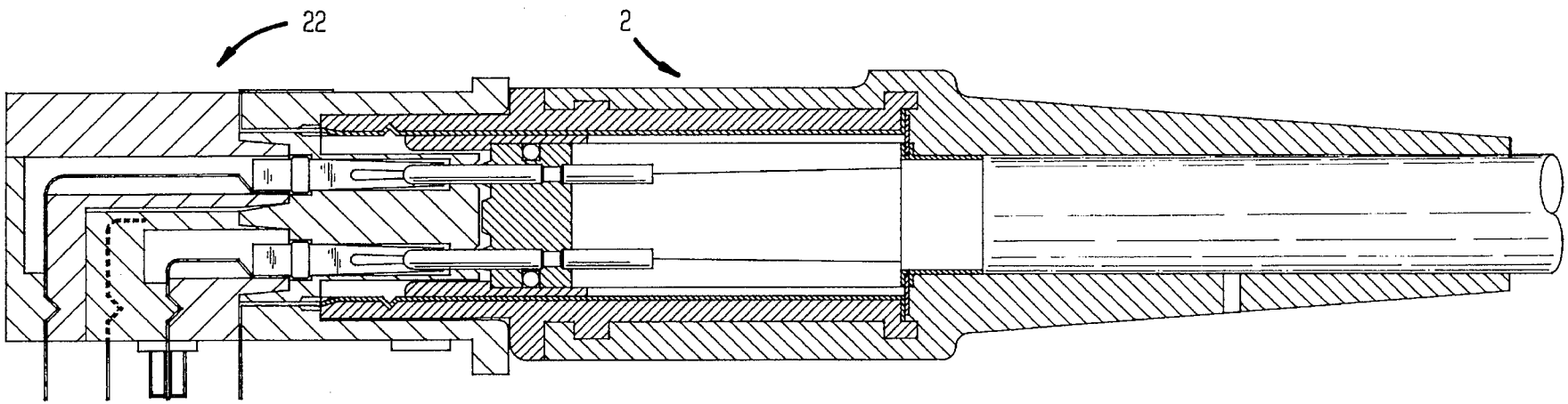
* and FIG. 3 illustrates the plug and receptacle type electrical connectors of FIGS. 1 and 2, respectively, in a mating electrical connection.

FIG. 3 illustrates the mating of electrical connectors 2 and 22. Note that the tab-like portions 27 of connector 22 are not accessible to being grasped by a user of the connector, due to their being recessed, in this case within first layer 28, but easily make connection in a substantially continuous manner to that portion 14 of shield 8 in connector 2 which is exposed along the inside surface of its front end 5.

Thus, what has been shown and described is a novel construction for an electrical connector which fulfills all the objects and advantages sought therefore. Many changes, modifications, variations and other uses and applications of the subject invention will, however, become apparent to those skilled in the art after considering this specification and its accompanying drawings, which disclose preferred embodiments thereof. For example, the number of individual tabs 29, 31 and 27 can be varied depending on design choice, as well as the number of electrical signal contacts and the shape of the connector, two rows of contacts, three rows, etc. Additionally, the position of exposed shield 14 can be varied, and a corresponding variation would be required for tabs 27. It should also be clear that the location of the pins and sockets can be interchanged, so that the receptacle could have the shield arrangement illustrated for the plug, and vice versa. Still furthermore, the structure of the plug and/or receptacle can be combined with and form a part of a larger structure having multiple plugs and/or receptacles. All such changes, modifications, variations and other uses and applications which do not depart from the spirit and scope of the invention are deemed to be covered by this patent, which is limited only by the claims which follow as interpreted in light of the foregoing description.

We claim:

1. A shielded electrical connector arrangement for defining a first connector, comprising:

an elongated annular housing portion composed of an electrically insulative material for forming an elongated structure for said first connector and at least a portion of a grasp for a user of said first connector, said housing having outside and inside surfaces and front and rear ends for defining said first connector;

a contact holding portion composed of an electrically insulative material positioned inside said annular housing portion, said contact holding portion including a plurality of electrically conductive signal contacts of a given length positioned therein in a longitudinal direction of said housing portion so as to be completely surrounded by, yet spaced a distance away from, the inside surface of said housing portion, with a rear end of each of said electrically conductive signal contacts adapted for being coupled to a respective one of a plurality of signal conductors having a common shield associated therewith, and a front end of each of said electrically conductive signal contacts extending in the direction of, but stopping a given distance short of, the front end of said housing portion; and an elongated annular electrically conductive shield having inner and outer sides, disposed between the outside surface of said housing portion and said electrically conductive signal contacts so as to surround, yet be spaced away from, said electrically conductive signal contacts, said elongated shield having a rear end connected to said common shield associated with the plurality of signal conductors and a front end portion extending in the direction of the front end of said housing portion a predetermined distance past the front end of said electrically conductive signal contacts but stopping short of the front end of said housing portion, with the front end of said housing portion being in direct annular contact with the outer side of the front end portion of said elongated shield, wherein said housing portion provides direct support for the front end portion of said elongated shield, as well as a continuous insulation for covering said elongated shield, wherein the front end portion of said shield includes on an inside surface thereof an annular depression portion that is adapted to make electrical contact and latch with at least one tab-like protrusion of a shield of a mating multi-conductor connector so as to provide an effectively continuous conductive shield which completely surrounds said electrically conductive signal contacts over their given length and wherein the front end of said housing portion extends past a front-most tip portion of said front end portion of said elongated shield, thereby preventing a user from touching the front end portion of said elongated shield.

2. The connector arrangement of claim 1, wherein said electrically conductive signal contacts comprise pin terminals.

3. The connector arrangement of claim 1, wherein:

said shield is insert molded with said housing portion so that the inside surface of said housing portion insulates the shield over substantially the given length of the electrically conductive signal contacts.

4. The connector arrangement of claim 3, wherein:

a front-most tip portion of the front end portion of said elongated shield is bent radially and outwardly away from said contact holding portion.

5. The connector arrangement of claim 4, wherein:

said elongated shield is insert molded with said housing portion so that the inside surface of said housing portion is in direct contact with not only the outer side of said elongated shield, but also in direct contact with the inner side of said front-most tip portion of the front end of said elongated shield, whereby the front end of said housing portion encapsulates the front-most tip portion of said front end of said elongated shield therein.

6. The connector arrangement of claim 1, further including a second connector for mating with said first connector, said second connector comprising:

an elongated annular housing portion composed of an electrically insulative material for forming outer and inner surfaces and front and rear ends for defining said second connector;

a contact holding portion composed of an electrically insulative material positioned inside said annular housing portion, said contact holding portion including a plurality of electrically conductive signal contacts of a given length positioned therein in an axial direction of said housing portion so as to be completely surrounded by, yet spaced a distance away from, the inside surface of said housing, with a rear end of each of said electrically conductive signal contacts being coupled to a respective one of a plurality of signal conductors having a common shield associated therewith, and a front end of each of said electrically conductive signal contacts extending in the direction of, but stopping a given distance short of, the front end of said housing, with the housing portion, contact holding portion and the electrically conductive signal contacts of said first and second connector being dimensioned so as to make a physical and electrical mating connection therebetween; and an elongated annular electrically conductive shield disposed in a space between the inside surface of said housing and said electrically conductive signal contacts so as to surround, yet be spaced away from, said electrically conductive signal contacts, said elongated shield having a rear end connected to said common shield associated with the plurality of signal conductors and a front end portion extending in the direction of said front end of said housing, the front end portion of said shield including at least one curved tab-like protrusion which extends into said space and is shaped so as to correspond with the shape of the annular depression portion in the elongated shield of said first connector, thereby forming a spring-like latch useful for making electrical connection to said annular depression portion in the shield of the first connector.

7. The connector arrangement of claim 6, wherein;

the shield of said first connector is insert molded with said housing portion so that the inside surface of said housing portion insulates the shield over the given length of the electrically conductive signal contacts;

the shield of said second connector comprises a plurality of said curved tab-like protrusions circumferentially arranged in said space about said electrically conductive signal contacts; and said space is dimensioned so as to receive therein the front end of the housing portion of said first connector, thereby allowing the tab-like protrusions of the shield of said second connector to make a circumferential connection to the annular contact portion in the shield of said first connector, thereby providing for continuity of the electrically conductive shields of the first and second connectors when they are connected together, in a manner which also insulates a user of the connectors from their respective shields.

8. The connector arrangement of claim 1, wherein said grasp comprises a portion of said housing having an overmold thereon of a material which is softer than the material composing the housing portion.

9. The connector arrangement of claim 1, wherein said annular depression portion is positioned in a portion of said shield that extends past the ends of said electrically conductive signal contacts.

10. A shielded electrical connector arrangement comprising a first and second connector, said first connector comprising:

an elongated housing portion composed of an electrically insulative material for forming an elongated structure for said first connector and at least a portion of a grasp for a user of said first connector, said housing having outside and inside surfaces and front and rear ends for defining said first connector;

a contact holding portion composed of an electrically insulative material positioned inside said annular housing portion, said contact holding portion including a plurality of electrically conductive signal contacts positioned therein so as to be completely surrounded by, yet spaced a distance away from, the inside surface of said housing portion, and with a front end of each of said electrically conductive signal contacts extending in the direction of, but stopping a given distance short of, the front end of said housing portion; and an elongated annular electrically conductive shield having inner and outer sides, disposed between the outside surface of said housing and said electrically conductive signal contacts so as to surround, yet be spaced away from, said electrically conductive signal contacts, said elongated shield having a rear end extending in the direction of the rear end of said housing portion and a front end portion extending in the direction of the front end of said housing portion, with the front end of said housing portion being in direct annular contact with the outer side of the front end portion of said elongated shield, wherein said housing portion provides a continuous direct support for the front end portion of said elongated shield, as well as insulation for covering said elongated shield, wherein the front end portion of said shield includes on an inside surface thereof an annular depression portion that is adapted to make electrical contact with at least one tab-like protrusion of a shield of a mating multi-conductor connector and wherein the front end of said housing portion extends past a front-most tip portion of said front end portion of said elongated shield, thereby preventing a user from touching the front end portion of said elongated shield;

and said second connector comprising:

an elongated annular housing portion composed of an electrically insulative material for forming outer and inner surfaces and front and rear ends for defining said second connector;

a contact holding portion composed of an electrically insulative material positioned inside said annular housing portion, said contact holding portion including a plurality of electrically conductive signal contacts of a given length positioned therein in an axial direction of said housing portion so as to be completely surrounded by, yet spaced a distance away from, the inside surface of said housing, with a rear end of each of said electrically conductive signal contacts being coupled to a respective one of a plurality of signal conductors having a common shield associated therewith, and a front end of each of said electrically conductive signal contacts extending in the direction of, but stopping a given distance short of, the front end of said housing, with the housing portion, contact holding portion and the electrically conductive signal contacts of said first and second connectors being dimensioned so as to make a physical and electrical mating connection therebetween; and an elongated annular electrically conductive shield disposed in a space between the inside surface of said housing and said electrically conductive signal contacts so as to surround, yet be spaced away from, said electrically conductive signal contacts, said elongated shield having a rear end connected to said common shield associated with the plurality of signal conductors and a front end portion extending in the direction of said front end of said housing, the front end portion of said shield including at least one tab-like protrusion which extends into said space for making an electrical connection to said annular contact portion in the shield of the first connector.

11. The connector arrangement of claim 10, wherein said annular depression portion in the shield of said first connector is positioned in a portion of said shield that extends past the ends of said electrically conductive signal contacts.

12. The connector arrangement of claim 10, wherein:

a front-most tip portion of the front end portion of said elongated shield of said first connector is bent radially and outwardly away from said contact holding portion.

13. The connector arrangement of claim 12, wherein:

said elongated shield of said first connector is insert molded with said housing portion so that the inside surface of said housing portion is in direct contact with not only the outer side of said elongated shield, but also in direct contact with the inner side of said front-most tip portion of the front end of said elongated shield, whereby the front end of said housing portion encapsulates the front-most tip portion of said front end of said elongated shield therein.

* * * * *